United States Patent [19]

Romberger

[11] Patent Number: 4,462,175

[45] Date of Patent: Jul. 31, 1984

[54] SAFETY TAG HOLDER

[76] Inventor: Mark W. Romberger, 53 Charlotte St., Manheim, Pa. 17545

[21] Appl. No.: 468,560

[22] Filed: Feb. 22, 1983

[51] Int. Cl.[3] ..... G09F 3/18

[52] U.S. Cl. ..... 40/10 R; 40/1; 40/2 R

[58] Field of Search ..... 40/10 R, 322, 617, 16, 40/1, 16.2, 16.4, 2 R; 206/806

[56] References Cited

U.S. PATENT DOCUMENTS

| | | | |
|---|---|---|---|
| 511,944 | 1/1894 | Gordon | 40/16.4 |
| 1,083,368 | 1/1914 | Kuhrt | 40/16.4 |
| 1,224,432 | 5/1917 | Wedge | 40/16.6 |
| 1,249,411 | 12/1917 | Joseph | 40/1 |
| 1,555,898 | 7/1923 | Wood | 40/16.4 |
| 1,710,296 | 4/1929 | Clark | 40/16.4 |
| 1,771,658 | 7/1930 | Sherwood | 40/16.4 |
| 2,047,632 | 7/1936 | Hopp | 40/16.4 |
| 3,164,126 | 1/1965 | Matel et al. | 40/16.6 |
| 3,241,255 | 3/1966 | Hanley | 40/2 R |
| 3,322,381 | 5/1967 | Bubb | 40/10 |
| 4,240,543 | 12/1980 | McKee | 40/10 R |
| 4,266,354 | 5/1981 | Daenen | 40/10 R |

*Primary Examiner*—Gene Mancene
*Assistant Examiner*—James Hakomaki
*Attorney, Agent, or Firm*—Martin Fruitman

[57] ABSTRACT

A safety tag holder for high voltage and other types of hazardous equipment. A flat holder, transparent on both sides with an intervening space between covers for insertion of a flat card, is constructed completely of electrical insulating material. A hook at one end of the holder is located in the same plane as the card and has a holding clip so the holder can not be accidentally removed from cables or rod upon which it is hung. A ring in the plane of the holder permits handling the holder with a pole which has a matching hook.

8 Claims, 2 Drawing Figures

SAFETY TAG HOLDER

SUMMARY OF THE INVENTION

This invention deals generally with card and sign exhibition and more specifically with safety or "lock out" tags. In many situations in industry it is a requirement for personnel and equipment safety that a label or tag be semi-permanently attached to equipment controls to give warning that the equipment should not be activated unless certain procedures are followed or personnel notified.

A typical example of such a need is one in which an electrician must repair a power line or some other uninsulated equipment while the power is turned off. In many such situations, for instance, when the equipment is in an enclosure or very remote from the power switch, the worker is not visible from the point at which power may be applied to the system. Even in the simple case of household wiring, a repairman can be working on wiring on the second floor, when power could be reapplied to the system at a switchbox in the basement.

Good safety practice dictates, and many industrial safety codes require, that in such circumstances the worker, before commencing repairs, first place a warning tag on the switch where he disconnects power to warn others not to reapply power. Generally such tags are not to be removed by anyone other than the person identified on the tag, the worker working in the dangerous area. In fact, theoretically, if six people are working on an electrical line six safety tags should be placed on the disconnect switch to assure that each person has indeed left the area before power is reapplied.

As is clear from the examples certain criteria are therefore required for such safety tags. Most important for safety of the workers is that the tags not be prone to accidental removal. However, certain other needs must also be fulfilled. The tags generally must be weather resistant; and for economy, should be reuseable. Moreover, the tags must be easily removeable when such removal is intentional and must be easily attachable. Experience suggests that safety devices which are difficult to use are not used when they should be, so this ease of attachment and detachment is in, in fact, critical. Another factor that should be considered is that in many instances safety tags must be attached by remote handling devices. Attachment to a high voltage line switch must frequently be accomplished by the use of a long safety pole. These safety poles have a short rod or hook at their remote end, but no other grasping means.

The present invention accomplishes all these desireable goals for a serviceable safety tag, but instead of using the tag itself, the invention fulfills the results by the use of a tag holder which can hold individual identifying tags. Each workman can therefore have personal safety tags, while the holder is interchangeable among workers and even companies.

The present invention is a holder constructed with transparent windows on both sides of a pocket for an identifying warning card and a hook with holding clip by which the holder is hung on cables, rods, valves or switch boxes. In addition a ring is attached adjacent to the hook so that the holder can be placed or removed from a device by use of a safety pole which has a hook or transverse rod at the working end.

The preferred embodiment of the holder is formed essentially from two sheets of transparent high voltage insulating material with a spacer to form the card pocket between the sheets. The card pocket is constructed with a card clamping feature, for instance, a wedge shaped retainer, to prevent accidental loss of the card. The hanging hook is formed integral with the windows with a wide hook opening located well below the uppermost part of the hook. This opening is closed off partially by a simple holding clip which requires positive force to either attach or remove the hook from an object.

The holding clip consists of a small diameter flexible rod with one end embedded in the card pocket portion of the holder and the other end adjacent to, but spaced apart from, the open end of the hook configuration. The spacing between the hook open end and the end of the holding clip is selected to be somewhat less than the smallest rod or wire likely to be used for hanging the tag holder. This spacing assures that the hook can not be moved off a rod on which it is hung without some force being applied. However, if force is applied the rod deflects until the hook slips off the item upon which it is hung. The rod can also consist of a tightly wound coil spring which furnishes the same resistance to movement along with the required flexibility.

The holder is constructed to be moved remotely by a safety rod, a tool which is common in high voltage installations such as switch yards and power houses. This safety rod is nothing more than a long pole of high voltage insulating material with a hook or similar fixture on one end. A typical end fixture is a short rod transverse to the axis of the long safety rod with the short rod having a slight enlargement or knob on the end.

The present invention therefore includes a small ring oriented in the same plane as the windows and hook and attached to the upper part of the holder behind the hook. This permits hanging the holder upon a safety rod by means of the ring, and using the extended reach of the safety rod, placing the tag holder on a wire or switch and then removing the safety rod from within the ring by moving the safety rod's hook out of the plane of the tag holder.

The safety tag holder can thereby be easily used to fulfill its warning function without requiring direct contact with dangerous equipment. Moreover, the electrical insulating characteristics of the holder further protect the user and also assure that the holder itself will not accidentally short circuit the equipment.

The safety tag holder of the invention is particularly valuable because its planar construction and double sided window pocket makes the tag inside highly visible, even from a distance, regardless of the side from which it is viewed. Moreover, the essentially planar construction makes storage or transportation of tags extremely easy. Several safety tag holders of the type of the present invention can be carried in a tool box with little interference with other items, and the tag holders described can also easily fit into a shirt pocket. Such ease of accessibility of the safety tag holder encourages use; and as with any safety system, the easier it is to use, the more likely that it will be used.

DETAILED DESCRIPTION OF THE INVENTION

Figure 2:
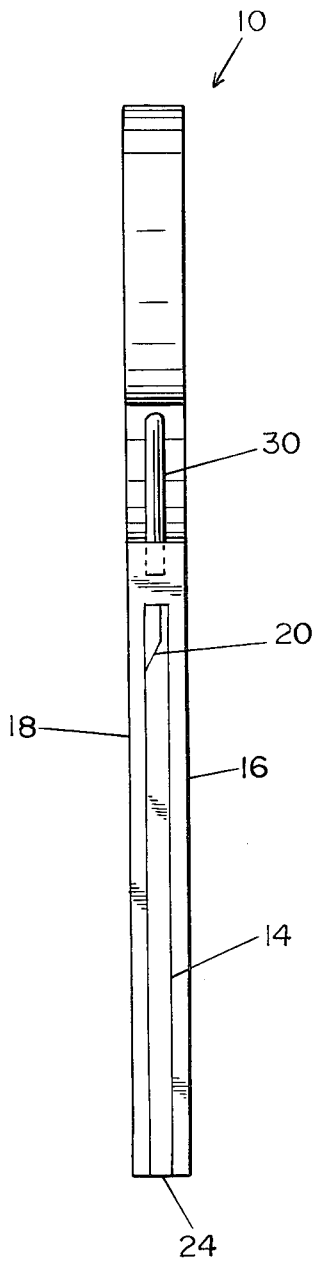
FIG. 2 is an end view of the preferred embodiment of the invention.
Figure 1:
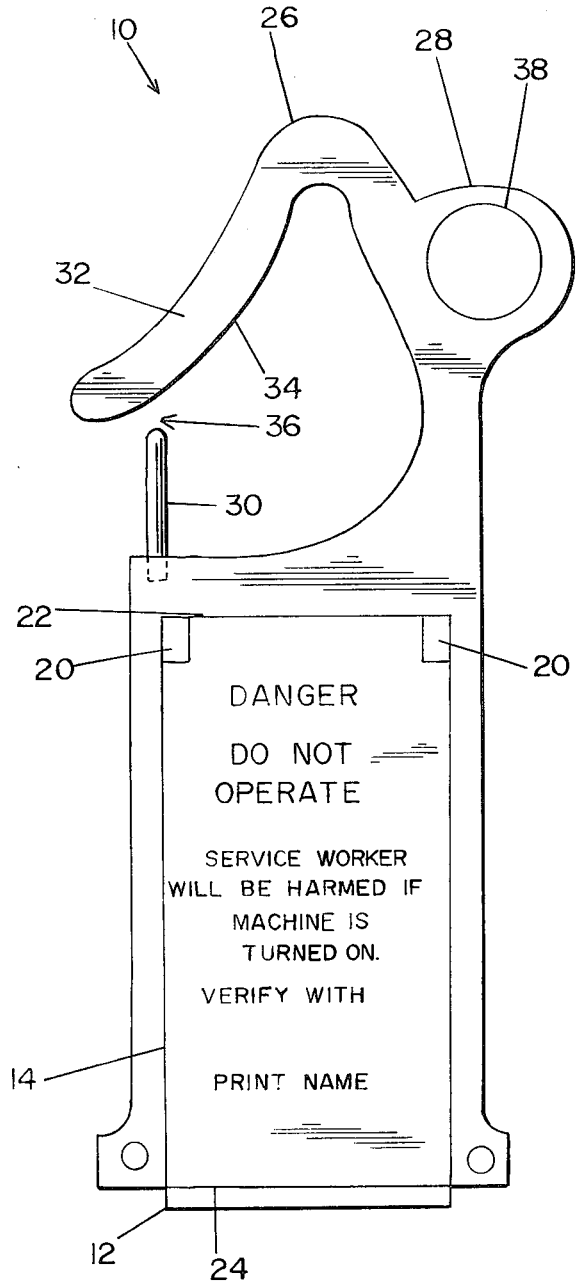
FIG. 1 is a side view of the preferred embodiment of the invention.

The preferred embodiment of the safety tag holder of the present invention is shown in FIG. 1 and FIG. 2. FIG. 1 is a side view of the preferred embodiment showing the general appearance of safety tag holder 10 as usually viewed with safety tag 12 inserted into pocket 14.

FIG. 2 is an end-on view of the same preferred embodiment 10 with the safety tag removed from pocket 14 to more clearly show the internal construction. Side panels 16 and 18 are both constructed of transparent material to permit clear viewing of safety tag 12 from either side of holder 10. Safety tag 12 is printed with the same legend on both sides.

Tag locks 20 are wedge shaped fixtures located at end 22 of pocket 14, remote from open end 24. Tag locks 20 push tag 12 tightly against window 16 after it has been inserted into pocket 14 to prevent accidental removal of tag 12.

Hook 26 and ring 28 make up the balance of safety tag holder 10, and although their construction with transparent material serves no function after manufacture, production economy dictates that the entire safety tag holder be constructed of one material. The same restraint suggests that the entire safety tag holder be made of a minimum of parts, typically only four. These could consist of two planar matching halves, one containing side panel 16 and the other side panel 18, with the pocket area formed by a spacer part. When the window parts are placed together with the spacer, hook 26 and ring 28 and the window edges are formed into a triple thickness while pocket 14 is formed by the absence of the tag holding area in the spacer part. The fourth part would be holding clip 30, a flexible fixture such as a rod or tightly coiled spring which is inserted and bonded into a recess formed by a small hole formed into the tag holding structure formed by panels 16 and 18 and pocket 14.

Hook 26 is constructed with a relatively long end finger 32 and steep slope 34 to assure that the weight of the tag holder will cause the rest position of hook 26 to be consistently at the highest point of the hook in order to make accidental detachment from the item to which it is attached less likely. Holding clip 30 serves the same purpose. It is a fixture constructed of such thickness that it is easily bendable and of material of such resiliency that it will spring back to the straight rod-shape shown. A tightly wound coil spring or flexible plastic rod is well suited for this use. The length of holding clip 30 is selected so that a clearance 36 remains between its end and hook end finger 32. The length of holding clip 30 is arranged to permit clearance 36 to be smaller than the size of the smallest wire or rod upon which safety tag holder 10 is to be hung. Holding clip 30 will therefore prevent accidental dislodging of safety tag holder by interfering with its movement off the wire or rod. When removal is desired, however, it is only necessary that the rod or wire be forced past holding clip 30 by deflecting it outward to increase clearance space 36. After deflection, holding clip 30 will spring back to the position shown. Attaching safety tag holder 10 to a rod or wire only requires relative movement of the rod or wire through clearance 36 in the reverse direction, thus deflecting holding clip 30 inward.

Ring 28 affords the user of safety tag holder 10 a means of manipulating it by a long safety pole. Ring 28 is shown formed high upon and adjacent to hook 26, but its function requires only that it be located above the center of gravity of safety tag holder 10, that it be located on the backside, the closed portion, of hook 26, and that it be essentially in the same plane as hook 26. Ring 28 with hole 38 permits a fixture such as a hook or traverse rod on the end of a long safety pole to be inserted into hole 38, and safety tag holder 10 can thus be manipulated and attached and detached to remote or dangerous locations by the use of a long insulated pole.

Safety tag holder 10 thereby affords a means to label equipment as out of service for maintenance, or identify it for some other reason, by the use of an insulated, easily handled, highly visible identification which will not be accidently detached and can easily be stored when not in use.

It is to be understood that the form of this invention as shown is merely a preferred embodiment. Various changes may be made in the function and arrangement of parts; equivalent mean many be substituted for those illustrated and described; and certain features may be used independently from others without departing from the spirit and scope of the invention as defined in the following claims.

For example pocket 14 need not be rectangular in shape, hook 26 can be of different geometry and hole 38 need not be circular.

What is claimed as new and desired to be secured by Letters Patent of the United States is:

1. A safety tag holder comprising:

two planar windows, oriented so that their planes are parallel, with a space between them to form a tag holding structure with a pocket for a safety tag;

a hook oriented in the same plane as the windows and attached at one edge of the tag holding structure; and a ring oriented in the same plane as the windows and attached to the backside and below the uppermost part of the hook to permit manipulating the hook by the ring using a fixture on the end of a safety pole.

2. The safety tag holder of claim 1 further including a tag capture means within the pocket.

3. The safety tag holder of claim 1 further including at least one wedge shaped means within the pocket which forces an inserted tag tightly against the inner surface of one of the windows to prevent accidental removal of the tag from the pocket.

4. The safety tag holder of claim 1 further including a holding clip comprising a flexible fixture one end of which is attached to the tag holding structure and the other end of which approaches but does not reach the open end of the hook to permit removing and attaching the safety tag holder by unidirectional movement which deflects the flexible fixture as the hook is slipped on and off an item upon which it hangs.

5. The safety tag holder of claim 4 wherein holding clip is a straight flexible rod which clears the open end of the hook by a distance less than the size of the item upon which the safety tag holder is to be hung.

6. The safety tag holder of claim 1 wherein the hook is constructed with a slope steep enough to assure that the weight of the safety tag holder will cause the rest position of the hook on a rod or wire to be at the highest point of the hook and will facilitate manipulation of the safety tag holder using a fixture on the end of a safety pole.

7. The safety tag holder of claim 4 wherein the holding clip is a straight coil spring.

8. The safety tag holder of claim 1 wherein the ring is located above the center of gravity of the safety tag holder to facilitate remote handling with a safety rod.

* * * * *